United States Patent [19]

Nemeth

[11] 4,215,861

[45] Aug. 5, 1980

[54] ELECTRONIC TENNIS GAME

[76] Inventor: Joseph J. Nemeth, 104 Providence Ave., Doylestown, Pa. 18901

[21] Appl. No.: 964,320

[22] Filed: Nov. 29, 1978

[51] Int. Cl.[3] ..... A63F 9/00

[52] U.S. Cl. ..... 273/85 G

[58] Field of Search ..... 273/85 G, 85 R, 237, 273/244, DIG. 28, 1 E; 340/323 R

[56] References Cited

U.S. PATENT DOCUMENTS

| | | | |
|---|---|---|---|
| 3,778,058 | 12/1973 | Rausch | 273/DIG. 28 |
| 3,874,669 | 4/1975 | Ariano et al. | 273/85 G |
| 3,904,203 | 9/1975 | Matsumoto | 273/85 R |
| 3,933,355 | 1/1976 | Pearce | 273/244 |
| 4,007,937 | 2/1977 | Casciano et al. | 273/244 |
| 4,017,072 | 4/1977 | Kurtz | 273/DIG. 28 |
| 4,026,555 | 5/1977 | Kirschner et al. | 273/85 G |
| 4,093,223 | 6/1978 | Wilke et al. | 273/85 G |
| 4,095,791 | 6/1978 | Smith et al. | 273/85 G |
| 4,119,955 | 10/1978 | Nichols | 273/DIG. 28 |
| 4,126,851 | 11/1978 | Okor | 273/85 G |
| 4,156,928 | 5/1979 | Inose et al. | 273/237 |

OTHER PUBLICATIONS

*Popular Electronics;* "Microprocessor Microcourse"; May, 1978; pp. 56-60.

*Funkschau;* "Electronic Table-Top Football"; Jul. 4, 1975; pp. 91-94.

*Primary Examiner*—Vance Y. Hum

*Attorney, Agent, or Firm*—James J. Cannon

[57] ABSTRACT

An electronic simulated tennis game is played on a gameboard which includes a matrix of multicolored light-emitting diodes scaled to resemble a tennis court. Each diode is positioned at a grid area and is illuminated to indicate ball and player positions. A keyboard is provided and competing players electronically enter their selected palying positions and the target positions for the ball. There is also provided a scoring display, switches to initiate play and light means which instructs the players as to points and movement results. This tennis game is played on a gameboard which is under the control of a programmed microcomputer which processes each player's inputs according to a simulated tennis game program and displays and computes the results of each player's selections on this gameboard and displays the results as to an error or a successful volley.

8 Claims, 9 Drawing Figures

ELECTRONIC TENNIS GAME

BACKGROUND OF THE INVENTION

1. Field of the Invention

This invention relates to electronic simulated tennis games for use in the home or parlor, utilizing an illuminated electronic gameboard, a keyboard providing for player interaction, and a programmed memory, introducing elements of chance and skill, and implemented electronically by the use of digital logic circuits, a microcomputer system and light-emitting diode displays.

2. Description of the Prior Art

The game of tennis is difficult to simulate in parlor gameboard techniques and, therefore, there are few prior patents in this general area. A typical toy-type game is disclosed in U.S. Pat. No. 3,904,203, which utilizes a ball at the end of a pivoting arm. A simulated parlor-type tennis game is disclosed in U.S. Pat. No. 3,933,355. The game of this patent uses a gameboard having a scale diagram of a tennis court with appropriate positions marked thereon. It utilizes as a random selection means three die cubes. It uses three mechanical indicators for ball flight, ball bounce and player position. Lastly, it uses a serve and lob chart for indicating the results of the first serve, second serve and lobs responsive to various combinations of the three die cubes.

The most recent tennis board game known to the inventor is that disclosed in U.S. Pat. No. 4,007,937. This gameboard utilizes a scaled tennis court divided into a grid whose coordinates indicate player and ball position. Selective cards and tiles determine ball and player positions and markers are placed on the gameboard to indicate these positions. The parlor game of this patent is one of the most recent and most sophisticated of the non-electrical simulated tennis games.

In the field of electrical and electronic simulated tennis games, the most popular and best known are those employing a cathode ray tube or an adapter connected to a standard television receiver. These are numerous prior patents on these devices and on the subsystems used in these devices. An example is U.S. Pat. No. 3,778,058. The assignee of that patent is also the assignee in many related patents.

The simulated tennis games of the prior art have numerous disadvantages. The nonelectric gameboard, plus dice, plus chart or card-type games lack a sense of realism and action. The physical means are not available for anticipating and incorporating all those elements of skill and chance which make a real game of tennis hold the interest of the players. The video-type electronic games have managed to incorporate speed of reflex response, but often at the cost of sacrificing skill and strategy. Thus, they also lack the sense of realism. Video-type games also have certain other disadvantages. Those which rely upon a standard television receiver lack portability. They are fragile and require service. And the more sophisticated simulated games can be very expensive to manufacture and purchase.

The object of the simulated tennis game of the present invention is to incorporate the best features of both nonelectrical games and electrical games and to improve upon the prior art by incorporating more elements of skill, strategy and chance into a microcomputer-controlled electronic gameboard.

SUMMARY OF THE INVENTION

This invention pertains to a microcomputer-controlled simulated tennis game using an electronic keyboard for player inputs and an electronic gameboard to display the results of a player's chosen input and his opponent's response thereto. The game incorporates elements of strategy, skill and chance. The keyed inputs of the opposing players are received by a microcomputer system which processes them according to a tennis simulation program and displays the results on the electronic gameboard. The electronic gameboard and the rules of the game are designated to conform as closely as possible to the actual game of tennis. This includes serving, volleying the ball, player movements and scoring.

The electronic gameboard includes a scaled tennis court with outer boundaries, intermediate lines and net represented thereon to define the playing and serving areas. For games purposes, the scaled tennis court and its immediately surrounding area are divided into a grid having horizontal and vertical coordinates so that each square within the grid is uniquely identifiable to the players and to the microcomputer. The grid lines, while visible to the players, are not as visually evident as the court lines. Provision is made to illuminate squares on the grid to indicate ball and player positions, color coding being used to distinguish between the ball and the players. For this purpose, each square is a multiple color LED. The grid may include an area larger than that of the scale tennis court both to indicate normal player positions, especially at the base line, and to indicate ball shots which are out of bounds.

The gameboard further includes a twelve-key keyboard for each player on which ten keys represent the ten digits and two code keys indicate whether the lateral (horizontal) or longitudinal (vertical) coordinate of a square on the grid is being selected by the keyed digits. By the use of both the code keys and the digit keys, a player can uniquely select any square on the grid both for his position and, when appropriate, the position of the ball. An error light appears above the keyboard to indicate invalid keyed inputs.

The gameboard further includes an on-off switch, a reset switch, a switch to indicate which player is serving and a multiple position switch so players can select a novice, intermediate or advanced level of play.

The gameboard also includes three indicator lights which tell a player whether he is to serve, volly or position himself on the gameboard by his next entry on the keyboard.

Lastly, the gameboard includes an LED display to indicate scoring in points, games and sets.

The electronic circuitry to support the gameboard operation includes a sixteen-line to four-line multiplexer (74154) which receives keyboard and reset inputs which are fed to an input/output control unit (such as an 8255) and then to a microprocessor (such as an 8085) having a memory unit (such as an 8755). After inputs from each player are processed according to a tennis simulation program, appropriate outputs are fed to the gameboard through the input/output control unit to additional multiplexers (74154) to illuminate the squares on which the players are positioned and the position of the ball. When a point is scored, an LED display is illuminated on the score section of the gameboard.

Using the electronic gameboard, two players may play a simulated game of tennis; or two teams may play a game of doubles. For purposes of description, only a game of singles will be described in terms of Player A and Player B. For doubles, one would simply substitute Team A and Team B and use the appropriate sidelines of the scaled tennis court. Initially, the gameboard is turned on and the reset button is pushed to set all displays to zero, to initiate the program and to turn off any illuminated squares on the tennis court grid. Each player then selects by switch or key whether he wishes to play a novice, intermediate or advanced game. This activates an odds selector in the microcomputer program which influences the probability of successful playing of a point on both serve and volley. The players then select which player is to serve by a visible toggle switch. Based on this information, the instruction indicator lights on each keyboard are illuminated, indicating to each player what data he should enter. At this point, each player then enters data on his keyboard. The server keys in the coordinates of the grid square to which he desires to serve within the appropriate service lines. At the same time, the player receiving the serve keys in the coordinates of the grid square on which he wishes to position himself to receive the serve. After a momentary delay, the keyed squares are illuminated and the program then determines the probability of the served ball hitting the desired square. All possibilities within tennis are considered by the program and its odds selector. For purposes of description, assuming the serve falls within the service area, the program then considers the probability of the receiving player returning the serve from his position. If that probability is below a threshold level for the level of play selected, the server scores a point. If it is above the threshold level, then the player instruction indicator lights come on to indicate to the receiving player that he should volley and to the server that he should position himself for the volley. Each player then keys in the coordinates of the appropriate grid squares, the receiving player indicating the square to which he wishes to return the ball and the other player indicating his desired position. The program will always position a player where he selects, but it will refer to an odds selector to determine where the ball lands and then whether the receiving player has a chance to successfully return the ball. Play continues until one player scores a point. The program always moves the ball and the player simultaneously to add suspense to the game. It also introduces a momentary delay between data inputs and its response for the same purpose. In the implementation of the gameboard, a multiple color LED is used for each square on the court grid to distinguish the player from the ball. Play is always under the control of the microcomputer which uses a program having weighted random probabilities to determine the outcome of each serve or volley. As mentioned, these probabilities may be varied by the user selection of the level of play.

The invention also includes the digital logic necessary to implement the electronic-simulated tennis game.

BRIEF DESCRIPTION OF THE DRAWINGS

FIG. 5 A is a schematic diagram of a typical segment driver.

DESCRIPTION OF THE PREFERRED EMBODIMENT

Figure 1:
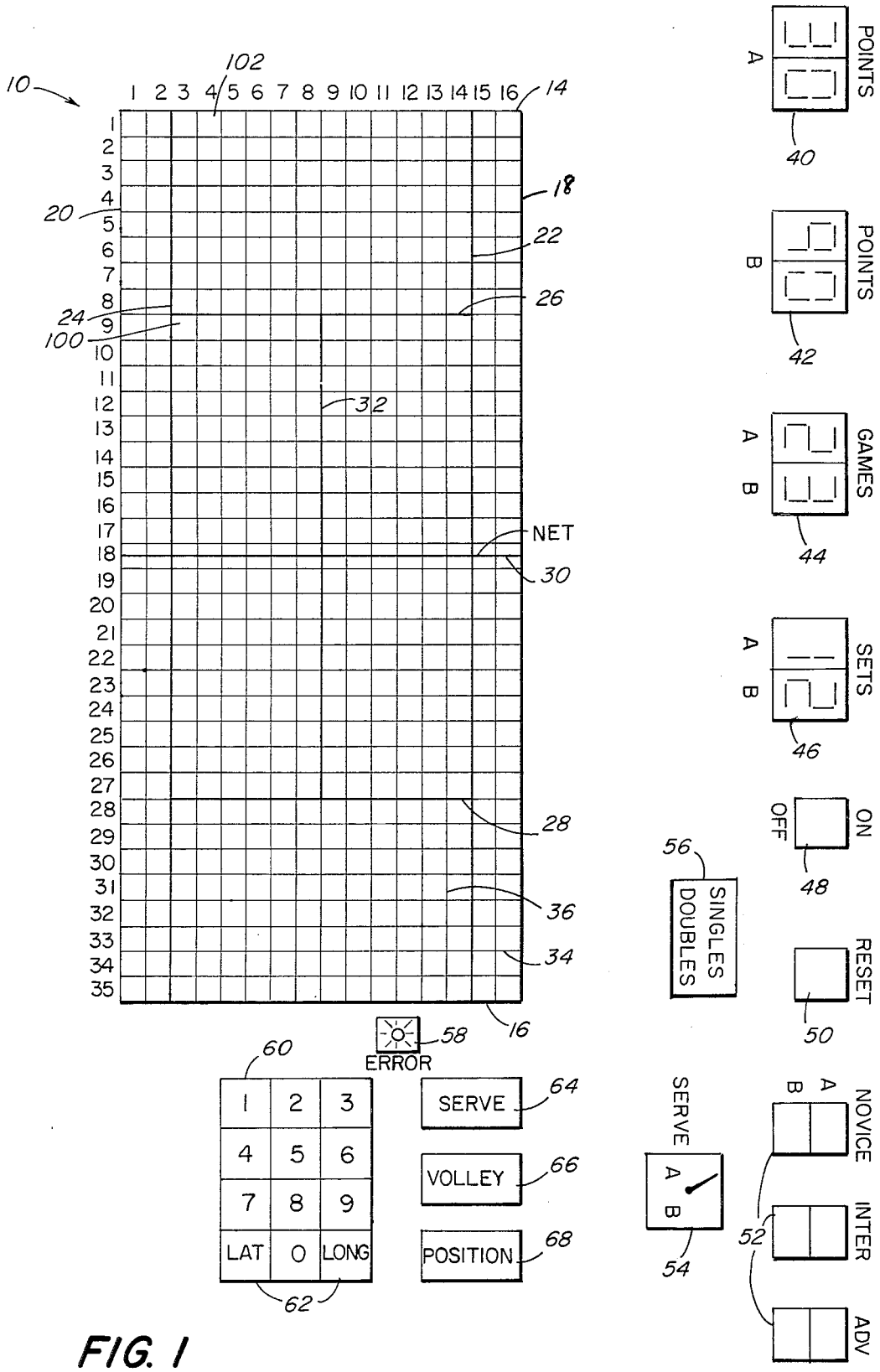
FIG. 1 is a partial top plan view of the electronic tennis gameboard of this invention with the redundant portions omitted.

This invention pertains to an electronic simulated tennis game having an electronically operated gameboard on which the progress of the game is displayed, an input keyboard for players to enter their game moves and a programmed microcomputer system which controls the course of the game play. The microcomputer system includes a microprocessor, a memory unit and an input/output control unit. The figures illustrate the various physical components of the electronic game and include a flow chart for its program sequence. The figures are not intended to illustrate the product design. They simply show the invention diagrammatically.

Referring now to the Drawings

FIG. 1 illustrates the basic electronic simulated tennis gameboard of the present invention. The electronic gameboard 10 includes a rectangular representation of a tennis court area 12, proportioned similarly to a standard-sized court, having opposite baselines 14, 16 across each end, outer boundary lines 18, 20 along each side, inner sidelines 22, 24 spaced from each outer side, service lines 26, 28 at intermediate lateral positions between lines 22, 24 and parallel to and spaced from each end a net 30 across the center of court 12 and a centerline 32 lengthwise between the two service lines 26, 28.

Court 12 is divided into a grid by horizontal and vertical lines, forming a plurality of generally square areas designated by numbered coordinates. For purposes of clarity of illustration, these numbered coordinates are shown from the viewpoint of one player, designated Player A. There are thiry-five squares along the outer sidelines 18, 20—numbered 1 to 35 along the length of the court, with the net 30 being across row 18. There are also sixteen squares numbered 1 to 16 across the width along the baselines 14, 16. The full width of court 12 is used for a game of doubles, while only that portion between the inner sidelines 22, 24 is used for a game of singles. The numbers 1 through 17 are used to facilitate locating the positions on the opposite sides of the court.

The players serve from behind the baselines 14, 16 and one side of the centerline 32 to hit the ball over the net 30 into the diagonally opposite service area bounded by the inner sidelines at 22, 24 and service lines 26, 28 along the court on each side of the net. Locking at court 12 from the position of Player A, the area from the service line 26 to the baseline 14 is called the backcourt while the area between the service line 26 and the net 30 is called the forecourt. After the serve, all returned balls must land over the net 30 between the inner sidelines 22, 24 and the baseline 16 for a singles games and between the outer sidelines 18, 20 and the baseline 16 for a doubles game.

On gameboard 10, the position of the ball is indicated by illuminating that square defined by its vertical and horizontal coordinates in the color green. The position of the player is indicated by illuminating his square with the color red. The means for illuminating the squares will be detailed hereinafter.

Gameboard 10 also includes scoring displays which may be light-emitting diodes (LEDs). Display positions are provided for Points 40, 42 for each player or doubles Team A, B; Games 44, and Sets 46. Scoring is identical to that of the game of tennis.

Gameboard 10 also includes an on-off switch 48 which is illuminated when the game is turned on, and a reset button 50 to reset all displays and circuits at the start of a game. In the electronic tennis game of the present invention, players can select whether they wish to play at the novice, intermediate or advanced level by pressing switches 52. The effect of this selection is to change the odds of successfully completing each stroke of the game. A switch 54 is provided to select which player or team will serve first. A switch 56 is provided to select whether the game will be singles or doubles. An error light 58 is provided to indicate an invalid switch or key input.

Each player or team is provided with a keyboard 60 having twelve keys representing the digits zero to nine and two coordinate keys 62, one to indicate a lateral or horizontal coordinate and one to indicate a longitudinal or vertical coordinate of the tennis court grid 12. Using the coordinate keys 62 followed by the digit keys, the player can select any square on the grid of court 12 to position either himself or the ball, as required by the game. The use of the keyboard 60 will be explained hereinafter.

Additionally, gameboard 10 is provided with instruction indicator lights which indicate to the player whether he is to Serve 64, Volley 66 or Position 68 himself on the court. These lights are illuminated by the microprocessor under program control to instruct the players as to which data should be keyed in. For example, if Player A is to serve, the microprocessor under program control will illuminate the serve light 64 at Player A's position and the position light 66 at Player B's position, indicating to Player A that he should key in the coordinates of the square on tennis court 12 to which he wishes to aim the serve and indicating to Player B that he should key in the coordinates of the square on tennis court 12 on which he wishes to position himself to receive the serve.

Figure 2:
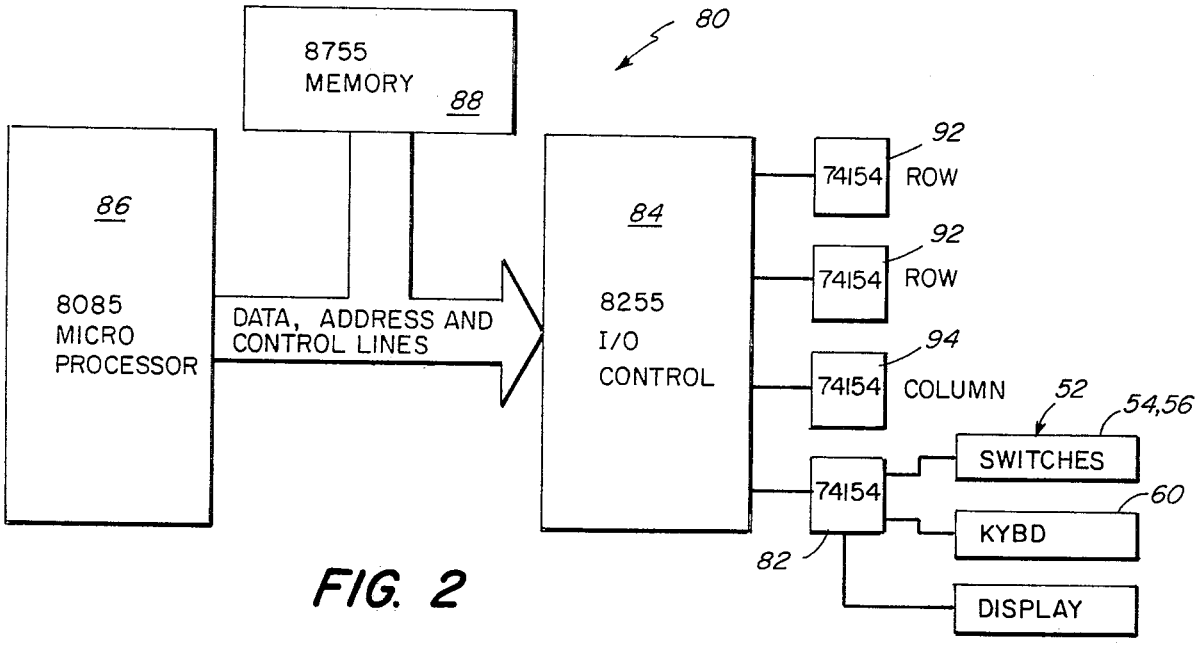
FIG. 2 is a block diagram of the microcomputer system which controls the gameboard of this invention.
Figure 3:
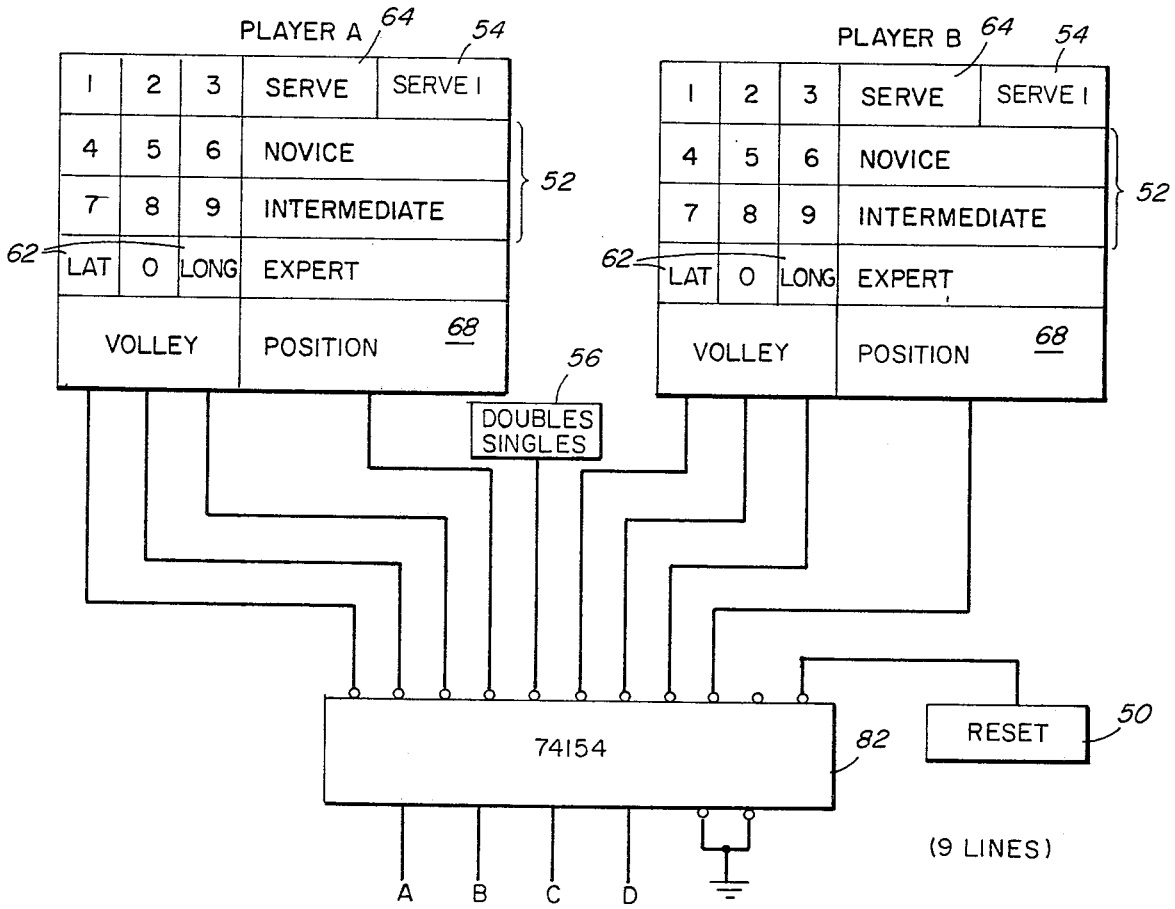
FIG. 3 is a partial schematic drawing of the keyboard and indicator light circuit.

Referring now to FIG. 2, the figure is a block diagram of the microprocessor controlled microcomputer system 80 which operates gameboard 10 under program control. System 80 is shown in outline form omitting the common and well-known functions such as on-off, the power supply, the reset controls and the like. All inputs to system 80 are entered through the keyboard 60 and switches 52 (level of play) 54 (serve), and 56 (singles or doubles). After initial start of the game with the on-off switch 48 in the on-position, the system 80 is reset by reset button 50, the level of play is set by switch 52, the choice of initial server is made by switch 54 and a singles or doubles game is selected by switch 56. The inputs from switches 52, 54 and 56 are processed by a sixteen-line to four-line multiplexer 82, such as a 74154, which also serves as the keyboard multiplexer. Data entered through the twelve keys of the keyboard is also processed through multiplexer 82. As illustrated in FIG. 3, ten lines of multiplexer 82 are utilized for inputs to System 80. From multiplexer 82, the input data is then processed by an input/output control unit 84, such as an 8085 (Intel) from which it is sent to microprocessor 86 for processing under program control. The program and volatile data are stored in a memory unit 88, such as an 8755 (Intel). The appropriate data, address and control lines 90 link the units of system 80 together. After the input data is processed by system 80, its output returns through input/output control unit 84 to gameboard 10 in the form of illuminated grid squares or illuminated scoring displays. The data for illuminated grid square passes through multiplexers 92, 94 which control the row and column coordinates, respectively. Display outputs proceed through multiplexer 82 which is also the keyboard multiplexer. All multiplexers 82, 92 and 94 are 74154 multiplexers, the row multiplexers 92 being six-line to 24-line multiplexers.

Referring now to FIG. 3, the Keyboards 60, Switches 50, 52 and 54, and Instruction Indicator Lights 64, 66, 68 are shown in a keyboard arrangement slightly different from that of FIG. 1. Keyboard 60 has twelve keys, ten representing the digits from zero to nine and two code keys 62, which are used to indicate the lateral or longitudinal coordinates of squares on tennis court grid 12. To key in a location, the player first keys in the appropriate code key 62 followed by the number of its coordinate on that axis, then the other code key 62 followed by its coordinate on the other axis. For example, if Player A wished to serve to the grid square labeled 100 on FIG. 1, he would key-in the sequence LONG 03 LAT 09. To position himself to receive the serve, Player B would key-in the sequence LONG 01 LAT 04, indicating grid square 102 of FIG. 1. The twelve keys of keyboard 60 are arranged in a three-by-four matrix which requires only three input lines to multiplexer 82. The Level Switch 52 requires one line. Hence, each player position uses only four lines, for a total of eight. The Reset Switch 50 uses the ninth input line and the singles-doubles switch 56 uses the tenth line to multiplexer 82. In the arrangement of FIG. 3, the instruction indicator lights Serve 64, Volley 66, Position 68, are shown in the keyboard layout. The operation of lights 64, 66, 68 is under program control of the microprocessor 86. These lights instruct each player what inputs he should key in and their control also serves as a validity check on the inputs. An invalid switch or key entry will cause error indicator light 58 to be illuminated (FIG. 1).

Figure 4:
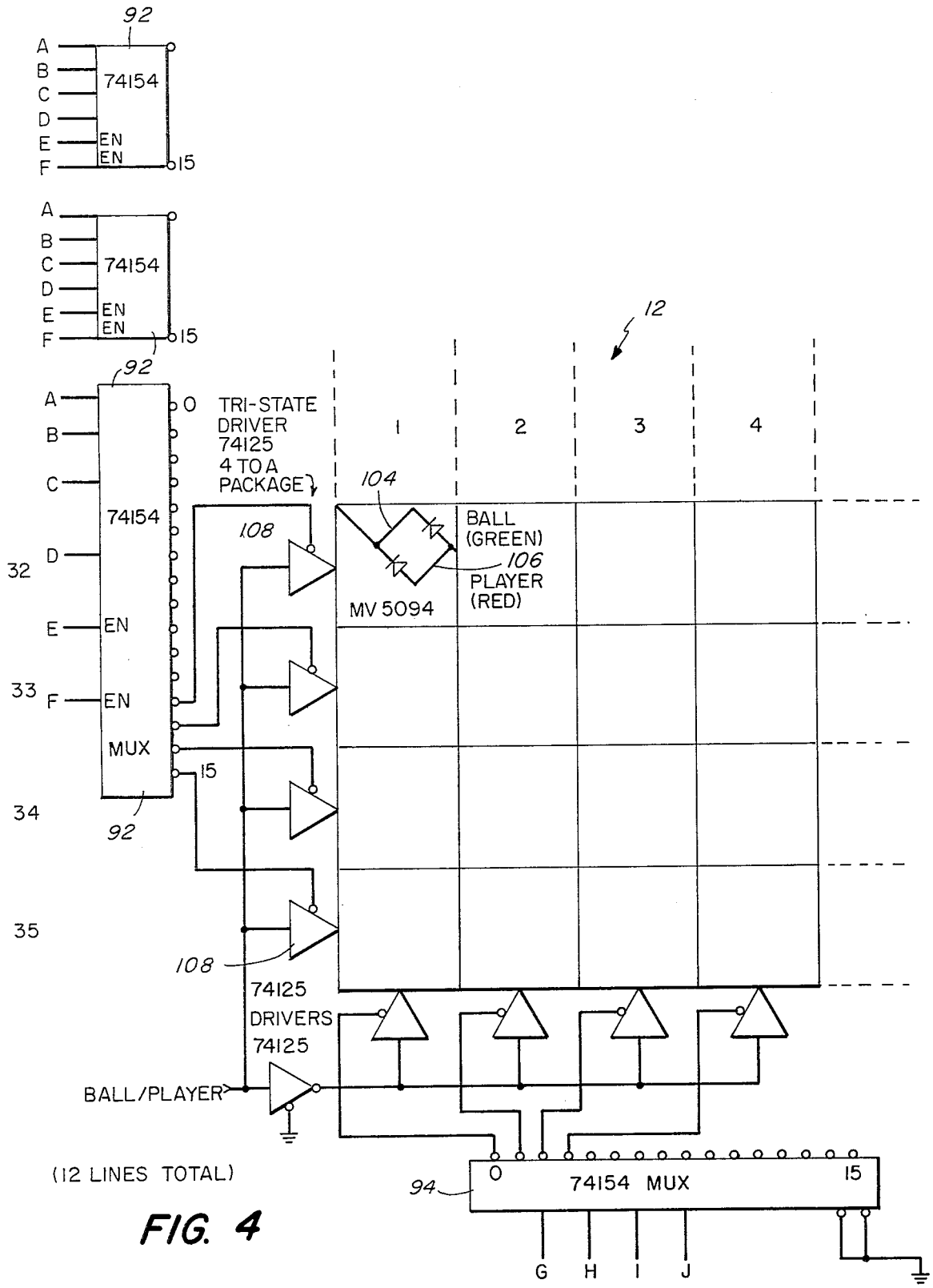
FIG. 4 is a partial circuit diagram of the tennis court grid of the present invention.

FIG. 4 is a partial schematic diagram of the circuit which is used to illuminate the tennis court grid 12 of gameboard 10. Sixteen grid squares are shown from columns 1 through 4 and rows 32 through 35 of FIG. 1. Each grid square 104 is a two color limit-emitting diode (LED) 106 known as MV5094 made by Monsanto. Using this LED 106, the player position is indicated by the color red and the ball position by the color green. Both colors can be illuminated on the same grid square 104 if the player and ball should meet on that square. In the course of the game three grid squares would normally be illuminated, one for the position of Player A, one for the position of Player B and one for the position of the ball.

Gameboard 10 is basically a matrix having an LED 106 (MV5094) tied to each intersection of a row and a column. The MV5094 LED's 106 are tied cathode to anode and anode to cathode, and they are tied in parallel but backwards with respect to each other. If the current passes through one way LED 106 will light up green; if it passes through the other way, LED 106 will light up red. LED's 106 are driven by tristate devices 108 such as the 74125 which source about sixty milliamperes. Each LED 106 requires about twenty milliamperes. When the output of a tristate device 108 is in an active high condition, it sources sixty milliamperes. Tristate device 108 can also sink any amount of current or in its third state it neither sinks nor sources current. Tristate device 108 usually is made in a package of four devices. One tristate device 108 is used to drive each row and each column of the grid matrix 12. The inputs to all tristate row drivers are tied together and the inputs to all tristate column drivers are tied together. The column tristate devices are inverted in relation to the row devices. For the grid square position of the ball to light up, the column tristate drivers sink current and the row tristate devices source current. For the position of the player to light up, this condition is reversed. Each tristate device 108 must source sixty milliamperes because the system is multiplexing among three positions, the ball, Player A and Player B for about one millisecond each. There will be no visible flicker because this time is long enough for tristate drivers 108 to be efficient. The time each LED 106 is on is long with respect to the switching time and hence there is no bleed-over, which would happen if one LED 106 is turned on before another is turned off. The output of each tristate device 108 goes to the row or column. The input of each tristate devices comes from the ball/player signal. The control or third lead tells the output to follow the input or to float (that is, neither sink nor source current). The control leads are tied to multiplexers 92, 94 (FIG. 2) which are connected to input/output control 84. Based on the keyed input and its program, microprocessor 86 feeds a code to input/output control 84 which holds the code in a latch and presents it to multiplexers 92, 94 which fan out and position the ball and players relative to the rows and columns.

Figures 5, 5A:
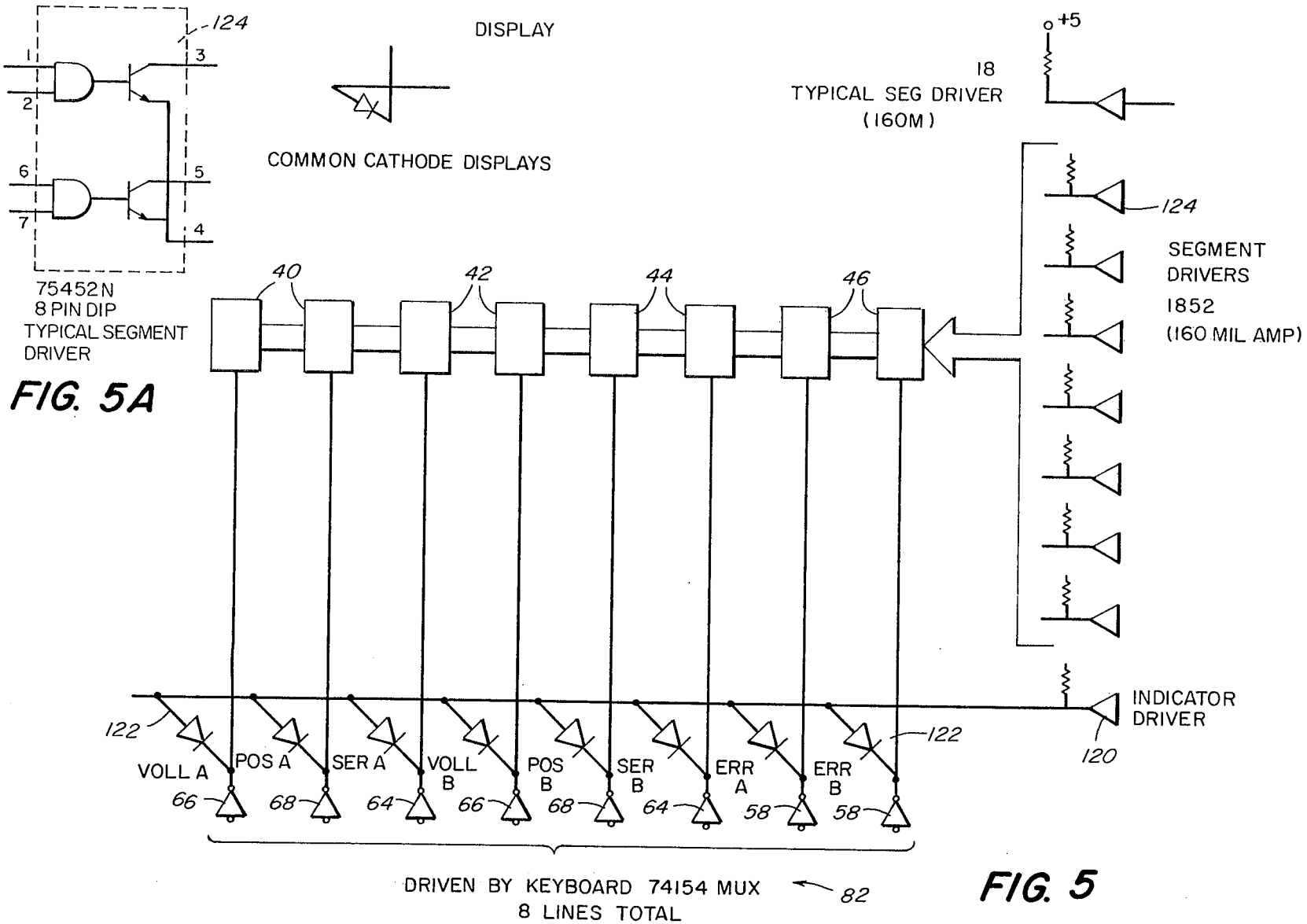
FIG. 5 is a schematic diagram of the display circuit of the gameboard of FIG. 1.

FIG. 5 shows the schematic drawing for the scoring displays 40, 42, 44 and 46, instruction indicator lights 64, 66 and 68 and error lights 58. Codes for these displays and lights come from input/output control 84 to the keyboard multiplexer 82. An indicator drive 120 serves to drive LED's 122. Eight segment drivers 124 are used to illuminate scoring displays 40, 42, 44 and 46.

FIG. 5 A is a schematic of a typical segment driver 124.

Figure 6A:
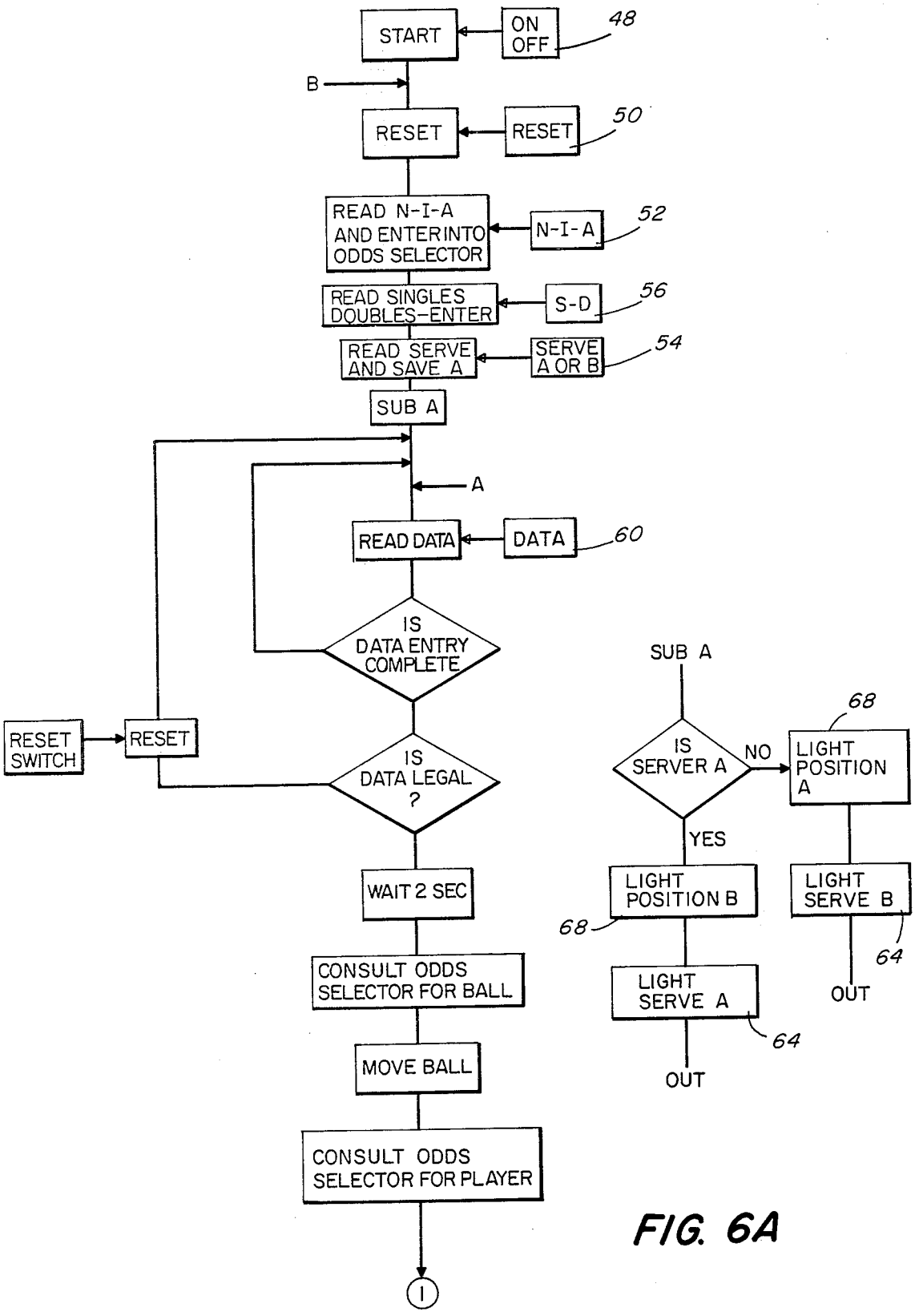
FIGS. 6 A, 6 B and 6 C are a flow chart of the program for the electronic-simulated tennis gameboard of this invention.
Figure 6B:
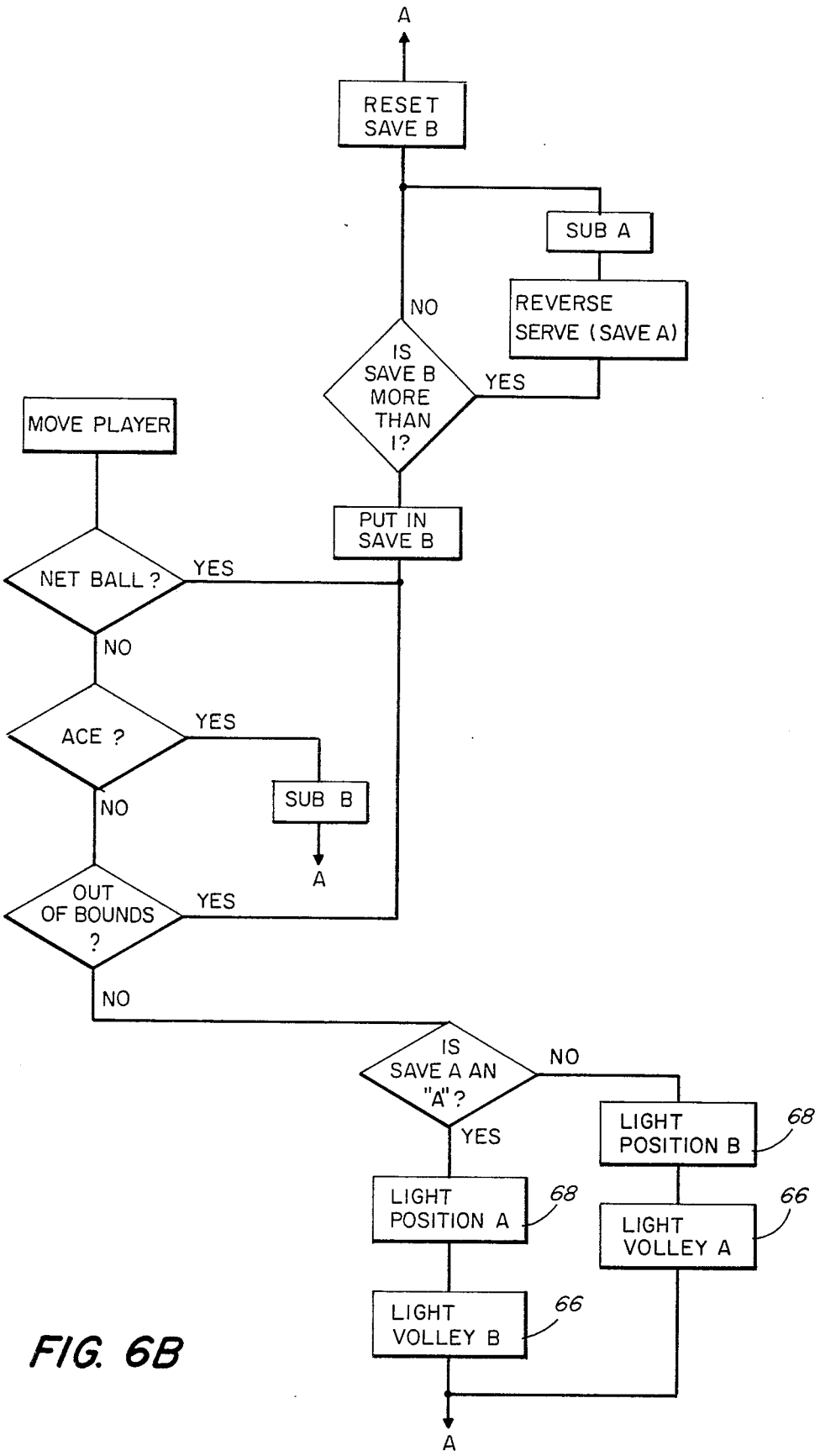
Figure 6C:
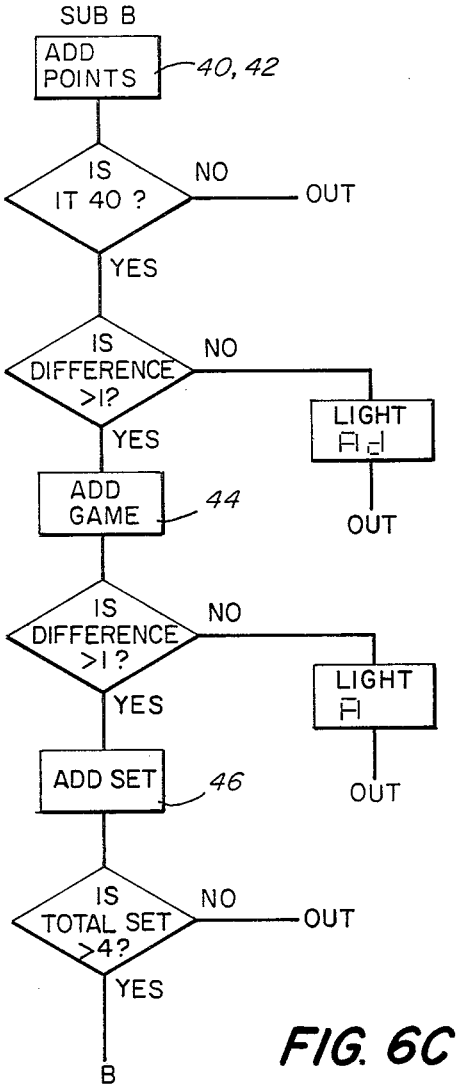

FIGS. 6 A, 6 B, and 6 C are a flow chart of the program used for electronic simulated tennis game 10. After start 48 and reset 50, the program reads the status of the level of play switches 52, singles-doubles switch 56 and initial serve switch 54. The system then reads the keyed input data from keyboard 60 and processes it, moving the players and the ball simultaneously after consulting an odds selector for the probability of the ball striking the intended grid square and for the probability of the player to return the ball from the position the player has chosen. The subroutines for the odds selectors take into account the angles of player positions and the level of play selected so that a real game of tennis may be simulated on gameboard 10. The flow chart of FIGS. 6A, 6B and 6C is self-explanatory with respect to scoring upon completion of a serve or volley and with respect to the player instruction indicator lights 64, 66 68.

For a game of doubles, appropriate modifications in the gameboard circuit would be made to illuminate two player positions on each side of the net and appropriate program modifications would be made in the program, especially the odds selector, to provide for volleying by four players rather than two.

It may be thus seen that the present invention provides a novel simulated tennis game using a microcomputer system to operate a realistic electronic gameboard. While one embodiment has been illustrated and described, it is apparent that many variations may be made in the particular form and construction without departing from the scope of the invention as set forth in the appended claims.

I claim:

1. An electronic apparatus for playing a simulated tennis game comprising:

a gameboard;

a rectangular tennis court area on said gameboard scaled to the dimensions of a regulation tennis court;

a plurality of equally spaced and visibly displayed longitudinal and lateral grid lines dividing said court area into a plurality of like rectangular grid areas;

coordinate markings along said grid lines to provide a unique identification of each of said rectangular areas in said grid, according to its row and column;

means to selectively illuminate each of said rectangular grid areas on said gameboard to indicate a presence of a ball or a player at said grid area;

a plurality of illuminated displays on said gameboard to indicate the scoring of said simulated tennis game;

a plurality of initiating switches adapted to illuminate said grids;

means on said gameboard to initiate, in response to the actuation of said switches, a simulated tennis game;

means on said gameboard for game players to select their desired player and ball positions while and when utilizing the grid area coordinates to indicate a ball or player at said positions;

a microcomputer system which and when actuated by said switches accepts inputs from said game initiating switches and from said keyboard and processes said inputs according to a simulated tennis game program to provide outputs in the form of illuminated rectangular grids on said gameboard to indicate respective player and ball positions in the game and to update said scoring displays when an error occurs and a point is scored.

2. The electronic tennis gameboard of claim 1 wherein said means to illuminate each of said rectangular grid areas comprises:

a matrix of multicolored light-emitting diodes tied to each intersection of said coordinate lines;

said light-emitting diodes being tied anode to cathode and cathode to anode in parallel but reversed with respect to each other;

a plurality of tristate devices to serve as drivers for said light-emitting diodes, one driver for each row and one for each column;

a plurality of multiplexers serving to connect said tristate devices to the output of said microcomputer system.

3. The electronic simulated tennis gameboard of claim 1 wherein said illuminated scoring displays comprise:

a plurality of seven segment light-emitting diodes;

a plurality of segment drivers connected to said light-emitting diodes;

a multiplexer which connects said segment drivers to the output of said microcomputer system.

4. The electronic tennis gameboard of claim 1 wherein said means to initiate said game comprise:

a plurality of switches;
one of said switches serving as an on-off switch;
one of said switches serving as a reset switch;
one of said switches serving to select the level of skill;
one of said switches serving to select the initial server;
one of said switches serving to select a singles or a doubles game;
a multiplexer connecting the output of said switches to the input of said microcomputer system.

5. The electronic tennis gameboard of claim 1 wherein said means to select ball and player positions comprises:
a twelve-key keyboard;
ten of said keys representing digits;
two of said keys representing codes for longitudinal and lateral coordinates;
a multiplexer which connects the output of said keyboard to the input of said microcomputer system.

6. The electronic tennis gameboard of claim 1 wherein said microcomputer system comprises:
an input/output control device;
a programmable memory device;
a microprocessor;
control, data and address lines connecting said input/output device, said memory device and said microprocessor;
said input/output device being connected to said multiplexers.

7. The electronic tennis gameboard of claim 1 further comprising:
a plurality of instruction indicator lights to indicate to each player what data said player should key in from his keyboard;
an error indication light to indicate an invalid data entry from said keyboard;
a driver for said instruction indicator lights and said error light;
said driver being connected to said scoring display multiplexer.

8. The electronic tennis gameboard of claim 7 wherein said keyboard multiplexer, said switch multiplexer, said scoring display multiplexer and said instruction light and error light multiplexer are the same multiplexer.

* * * * *